US012709459B2

(12) United States Patent
Schinasi

(10) Patent No.: US 12,709,459 B2
(45) Date of Patent: Aug. 18, 2026

(54) BAG FOR THE TRANSPORT AND STORAGE OF BULK GOODS AND METHOD OF PRODUCING SUCH A BAG

(71) Applicant: Codefine International SA, La Tour-de-Peilz (CH)

(72) Inventor: Piero Schinasi, Epalinges (CH)

(73) Assignee: Codefine International SA, La Tour-de-Peilz (CH)

( * ) Notice: Subject to any disclaimer, the term of this patent is extended or adjusted under 35 U.S.C. 154(b) by 75 days.

(21) Appl. No.: 18/038,278

(22) PCT Filed: Dec. 7, 2021

(86) PCT No.: PCT/IB2021/061423
§ 371 (c)(1),
(2) Date: May 23, 2023

(87) PCT Pub. No.: WO2022/123445
PCT Pub. Date: Jun. 16, 2022

(65) Prior Publication Data

US 2024/0092562 A1 Mar. 21, 2024

(30) Foreign Application Priority Data

Dec. 7, 2020 (EP) ..... 20212307

(51) Int. Cl.
*B65D 88/16* (2006.01)

(52) U.S. Cl.
CPC ..... *B65D 88/1687* (2013.01)

(58) Field of Classification Search
CPC ..... B65D 88/1687
(Continued)

(56) References Cited

U.S. PATENT DOCUMENTS 4,499,599 A 2/1985 Polett et al.
5,607,237 A * 3/1997 LaFleur ..... B65D 88/1681 383/17
2019/0367264 A1 12/2019 Schinasi

FOREIGN PATENT DOCUMENTS

BR MU9100805 U2 * 2/2014
BR 202015000679 U2 * 8/2015
(Continued)

OTHER PUBLICATIONS

CN209480396U machine translation (Year: 2019).*
(Continued)

*Primary Examiner* — Nathan J Newhouse
(74) *Attorney, Agent, or Firm* — Taft Stettinius & Hollister LLP

(57) ABSTRACT

A bag for the transport and storage of bulk goods including a main body having at least a bottom part and four sides connected in pairs along adjacent edges to form vertical ridges at four corners of the bag. The bag further includes four lifting straps, each having first and second end sections and an intermediate section rising above a top surface of the bag. The lifting straps are interconnected in pairs by two sleeves to form tubings or ducts extending longitudinally along a top surface of the bag to allow lifting of the bag by means of a forklift. The sleeves are connected to the main body of the bag via the lifting straps and are not attached longitudinally to the main body of the bag. Furthermore, the first and second end sections of each lifting strap are secured to corresponding sides of the bag.

35 Claims, 16 Drawing Sheets

(58) Field of Classification Search
USPC ..... 383/20, 22, 24
See application file for complete search history.

(56) References Cited

FOREIGN PATENT DOCUMENTS

| | | | | | |
|---|---|---|---|---|---|
| CN | 209480396 | U | * | 10/2019 | |
| DE | 29711972 | U1 | | 9/1997 | |
| WO | 9854070 | A1 | | 12/1998 | |
| WO | 0118293 | A1 | | 3/2001 | |
| WO | 2014192993 | A1 | | 12/2014 | |
| WO | WO-2015077851 | A1 | * | 6/2015 | ..... B65D 88/1687 |
| WO | WO-2018117293 | A1 | * | 6/2018 | ..... B65D 33/06 |
| WO | 2018142196 | A1 | | 8/2018 | |
| WO | 2019155330 | A1 | | 8/2019 | |

OTHER PUBLICATIONS

International Search Report; European Patent Office; International Application No. PCT/IB2021/061423; Feb. 24, 2022; 5 pages.
Written Opinion of the International Searching Authority; European Patent Office; International Application No. PCT/IB2021/061423; Feb. 24, 2022; 5 pages.

* cited by examiner

BAG FOR THE TRANSPORT AND STORAGE OF BULK GOODS AND METHOD OF PRODUCING SUCH A BAG

CROSS REFERENCE TO RELATED APPLICATIONS

This application is a U.S. national stage filing of International Patent Application No. PCT/IB2021/061423 filed Dec. 7, 2021, which claims priority to European Application No. 20212307.1 filed Dec. 7, 2020, the contents of each application are hereby incorporated by reference in their entirety.

International (PCT) Publication No. WO 98/54070 A1, which publication is incorporated herein by reference in its entirety, discloses a bag for the transport and storage of bulk goods. Different embodiments of the bag are disclosed in WO 98/54070 A1 and are reproduced in FIGS. 1A to 1E hereof. Such bags are also commonly referred to in the art as "big bags".

TECHNICAL FIELD

The present invention generally relates to a bag for the transport and storage of bulk goods.

BACKGROUND OF THE INVENTION

One example of a known bag is shown in FIG. 1A. This known bag, generally designated by reference numeral 10, comprises at least a bottom part 5 and four sides 1 to 4 connected in pairs along adjacent edges to form vertical ridges at four corners of the bag 10. As schematically shown in FIG. 1A, the bag 10 may further be provided with a lid closing the upper part thereof and provided with an aperture or spout to transfer goods inside the storage area of the bag 10. The bag 10 of FIG. 1A further comprises four lifting straps 6 provided in an upper portion of the bag 10 along the vertical ridges of the bag 10, which lifting straps 6 allow lifting of the bag 10 by means of a conventional four-point lifting device, such as a crane equipped with a four-point anchoring system.

Another known bag 10' is shown in FIGS. 1B-D, in which the lifting straps 6 of FIG. 1A are replaced by lifting straps 8 that are interconnected in pairs by two sleeves 7 to form tubings or ducts extending along an upper longitudinal end of two opposite sides 2, 4 of the bag 10' to allow lifting thereof by means of a forklift 50, as schematically depicted in FIG. 1D. The two sleeves 7 are particularly advantageous in that they favour and facilitate insertion and guiding of the fork arms 51 of the forklift 50 through the lifting straps 8, which lifting straps 8 are designed as structural elements supporting the bag's load.

Another known bag 10" is shown in FIG. 1E, which bag 10" combines the lifting abilities of bag 10 of FIG. 1A and bag 10' of FIGS. 1B-D, namely by providing additional lifting straps 9 on an upper end of the bag 10", next to the lifting straps 8 that form an integral part of the sleeves 7. Thanks to this arrangement, the bag 10" can either be lifted by means of a conventional four-point lifting device, using the additional lifting straps 9 as anchor points, or by means of a forklift, using the lifting straps 8, as already illustrated in FIG. 1D.

A variant of the bag 10" shown in FIG. 1E, as disclosed in WO 98/54070 A1, may consist in arranging the additional lifting straps so as to form closed loops around the lifting straps 8, like two links of a chain.

International (PCT) Publication No. WO 2018/142196 A1, which publication is likewise incorporated herein by reference in its entirety, discloses yet another bag for the transport and storage of bulk goods. FIGS. 1F and 1G show such a bag 10" where an intermediate section 8*c* (see FIG. 1G) of each lifting strap 8 forms an oblong loop, between the two ends 8*a*, 8*b* that are sewn along each vertical ridge of the bag 10'", and is positioned lengthwise along an upper edge of the bag 10", thus forcing the sleeves 7 to remain above a top surface of the bag 10". The bag 10" further comprises four restraining straps 8A each having two non-overlapping vertical sections 8Aa, 8Ab separated by a U-shaped intermediate section 8Ac, each vertical section 8Aa, 8Ab being sewn on one of the sides 1-4 of the bag 10", while the U-shaped intermediate section 8Ac is positioned over the intermediate section 8*c* of a corresponding one of the lifting straps 8 and is at least partially sewn thereon. The restraining straps 8A are configured to limit extension, in the vertical direction, of the top of the oblong loops formed by the intermediate sections 8*c* of the lifting straps 8.

Another bag of the type comprising two pairs of lifting straps connected by sleeves is disclosed in International (PCT) Publication No. WO 2019/155330 A1.

A problem with the known bags however resides in that the aforementioned sleeves are relatively costly to produce and integrate on the bag. The sleeves are furthermore subjected to relatively important stresses upon lifting the bag and may furthermore cause undesired deformation of the sides of the bag of which they form an integral part.

International (PCT) Publication No. WO 2014/192993 A1 discloses a bag according to the preamble of claim 1. More specifically, WO 2014/192993 A1 discloses a bulk bag having self-standing ring structures acting as lifting straps, which ring structures are filled with air to maintain the ring structures in a standing state to facilitate lifting and handling operations by means of a forklift. In accordance with embodiments described with reference to FIGS. 10-18 of WO 2014/192993 A1, each ring structure is designed as an inflatable tube that is wound on itself to form a closed loop, after which it is inflated by filling it with air. More specifically, one end of the tube is inserted through a slit provided at another end of the tube to form the closed loop, after which it can be inflated. Each closed loop can be attached, for instance by means of a zipper, to a corresponding end of a sleeve to form a pair of tubings or ducts extending longitudinally along a top surface of the bag to allow lifting of the bag by means of a forklift (see especially FIGS. 11, 17 and 18 of WO 2014/192993 A1). As a result, each of the two sleeves is connected to the main body of the bag exclusively via the associated pair of ring structures and is not otherwise attached longitudinally to the main body of the bag. This being said, the particular configuration of the ring structures of this embodiment implies that each ring structure, once formed in a closed loop, can only be secured by one end section to the main body of the bag, which is not an entirely adequate solution from the point of view of load distribution and safety in the event of a rupture of one or multiple ring structures. Furthermore, the ring structures are in effect quite complex to produce and must be designed to be fully airtight to ensure that they remain in the inflated state. Robustness is therefore an issue in practice as the ring structures can be damaged relatively easily in use and thereby deflate.

There is therefore a need for an improved solution.

SUMMARY OF THE INVENTION

A general aim of the invention is to provide a bag for the transport and storage of bulk goods that obviates the problems and limitations of known bags.

More specifically, an aim of the invention is to provide such a bag that is capable of being lifted by means of a forklift and facilitates lifting and handling operations.

A further aim of the invention is to provide such a bag that is of simpler construction and is less expensive to manufacture than the known bags, without in any way compromising bag robustness.

These aims are achieved thanks to the solutions defined in the claims.

In accordance with the invention, there is provided a bag for the transport and storage of bulk goods the features of which are recited in claim 1, namely such a bag comprising a main body including at least a bottom part and four sides connected in pairs along adjacent edges to form vertical ridges at four corners of the bag. The bag further comprises four lifting straps, each comprising first and second end sections and an intermediate section rising above a top surface of the bag. The lifting straps are interconnected in pairs by two sleeves to form tubings or ducts extending longitudinally along a top surface of the bag to allow lifting of the bag by means of a forklift. The sleeves are connected to the main body of the bag via the lifting straps and are not attached longitudinally to the main body of the bag. According to the invention, and in contrast to the solution disclosed in WO 2014/192993 A1, the first and second end sections of each lifting strap are secured to corresponding sides of the bag, which ensures appropriate load distribution and increased safety. Moreover, the bag of the invention is beneficial in that the sleeves remain substantially parallel to one another independently of any bulging of the main body of the bag, thus allowing optimal cooperation of the fork arms of the forklift with the sleeves.

According to a particularly advantageous embodiment of the invention, the first and second end sections of each lifting strap are non-overlapping vertical end sections that are sewn on different portions of the corresponding sides of the bag, and the intermediate section of each lifting strap is a U-shaped intermediate section rising above the top surface of the bag. In that context, the first and second end sections preferably extend and are sewn vertically along substantially all of the relevant portions of the corresponding sides of the bag (i.e. along at least 80% of the height of each side). In particular, the first and second sections may be sewn on different portions of a front or rear side of the bag.

According to a further advantageous embodiment of the invention, the intermediate section of each lifting strap is reinforced to force the intermediate section into an essentially upright configuration rising above the top surface of the bag when no load is applied onto a top portion of the bag. In particular, the intermediate section may be reinforced by means of a flexible reinforcement tube surrounding the intermediate section. The flexible reinforcement tubes may especially be made of a flexible polymer or biopolymer material, such as polyvinyl chloride (PVC), polyethylene (PE), bio-polyethylene (bio-PE), polypropylene (PP), bio-polypropylene (bio-PP) or silicone.

In accordance with a particularly preferred embodiment of the invention, terminal ends of the sleeves are each provided with a hem surrounding part of the intermediate section of the associated lifting strap and thereby provide connection of the sleeves to the main body of the bag. Each hem may especially surround part of the flexible reinforcement tube mentioned above. Each hem may in particular be formed by folding and stitching a terminal portion at each terminal end of the sleeves. In this latter context, the hem is preferably not stitched to the intermediate section of the associated lifting strap. More advantageously, each hem is configured to allow a relative movement of each hem with respect to the intermediate section of the associated lifting strap.

In addition, a bottom portion of each sleeve, at each terminal end of each sleeve, may advantageously be secured to the top surface of the bag, thereby ensuring that each terminal end of each sleeve remains in a generally open configuration to facilitate insertion of the fork arms of a forklift.

Advantageously, the sleeves may be made of a transparent or translucent material, which facilitates handling operations with a forklift.

Also claimed is a method of producing a bag for the transport and storage of bulk goods, the features of which are recited in claim 15, namely such a method comprising the following steps:

a) producing a pair of sleeves independently of a main body of the bag;

b) producing two pairs of lifting straps each comprising first and second end sections and an intermediate section;

c) connecting each terminal end of each sleeve to the intermediate section of a corresponding one of the lifting straps; and d) securing the first and second end sections of each lifting strap to corresponding sides of the bag so that the intermediate section rises above a top surface of the bag, wherein the sleeves are connected to the main body of the bag via the lifting straps and are not attached longitudinally to the main body of the bag.

Advantageously, the first and second end sections of each lifting strap are secured to the corresponding sides of the bag at step d) by stitching. In particular, the first and second end sections of each lifting strap are non-overlapping vertical end sections that are sewn at step d) on different portions of the corresponding sides of the bag, and the intermediate section of each lifting strap is a U-shaped intermediate section rising above the top surface of the bag. In this latter context, the first and second end sections preferably extend and are sewn vertically along substantially all of the relevant portions of the corresponding sides of the bag (i.e. along at least 80% of the height of each side). The first and second end sections may especially be sewn on different portions of a front or rear side of the bag.

By way of preference, the method further comprises the step of reinforcing the intermediate section of each lifting strap to force the intermediate section into an essentially upright configuration rising above the top surface of the bag when no load is applied onto a top portion of the bag. The intermediate section may especially be reinforced by surrounding the intermediate section of each lifting strap with a flexible reinforcement tube. The flexible reinforcement tubes may in particular be made of a flexible polymer or biopolymer material, such as polyvinyl chloride (PVC), polyethylene (PE), bio-polyethylene (bio-PE), polypropylene (PP), bio-polypropylene (bio-PP) or silicone.

Advantageously, the step c) of connecting each terminal end of each sleeve to the intermediate section of the corresponding lifting strap includes providing each terminal end of the sleeves with a hem and surrounding part of the intermediate section of the associated lifting strap with the hem, thereby providing connection of the sleeves to the main body of the bag. More specifically, in the event the intermediate section is reinforced by means of the aforementioned flexible reinforcement tube, the step c) of connecting each terminal end of each sleeve to the intermediate section of the corresponding lifting strap includes providing each terminal end of the sleeves with a hem and surrounding part of the flexible reinforcement tube, and thus part of the intermediate section of the associated lifting strap, with the hem, thereby providing connection of the sleeves to the main body of the bag.

Each of the aforementioned hems may be formed by folding and stitching a terminal portion at each terminal end of the sleeves. Preferably, the hem is not stitched to the intermediate section of the associated lifting strap. More advantageously, each hem is formed such as to allow a relative movement of each hem with respect to the intermediate section of the associated lifting strap.

The method may further comprise the step of securing a bottom portion of each sleeve, at each terminal end of each sleeve, to the top surface of the bag, thereby ensuring that each terminal end of each sleeve remains in a generally open configuration to facilitate insertion of the fork arms of a forklift.

Furthermore, the sleeves may advantageously be made of a transparent or translucent material to facilitate handling operations with a forklift.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and are illustrated by the appended drawings in which.

DETAILED DESCRIPTION OF EMBODIMENTS OF THE INVENTION

Figure 1A:
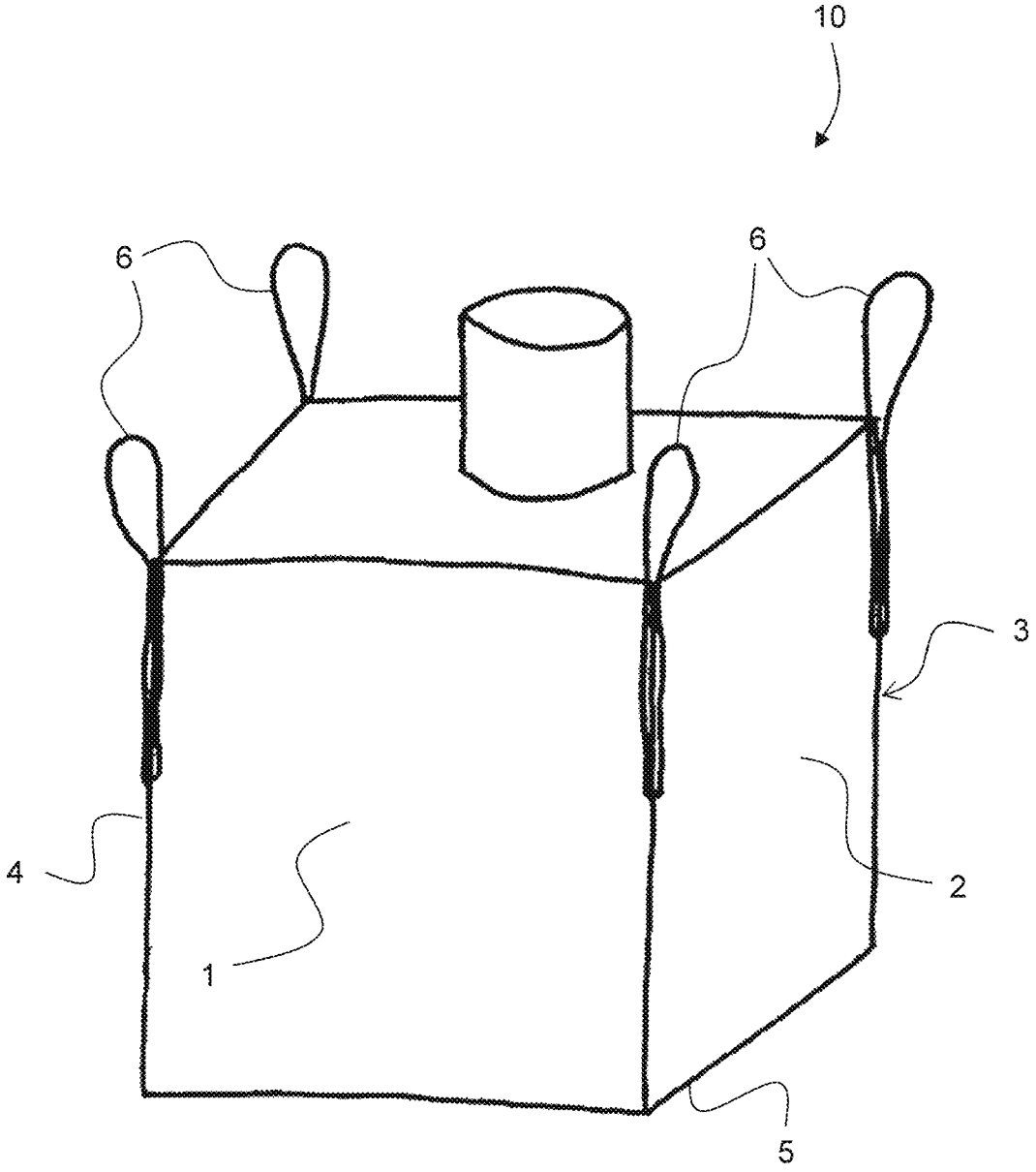
Fig. 1A (PRIOR ART)
FIGS. 1A-E are schematic illustrations of prior art bags as disclosed e.g. in International (PCT) Publication No. WO 98/54070 A1.
Figure 1B:
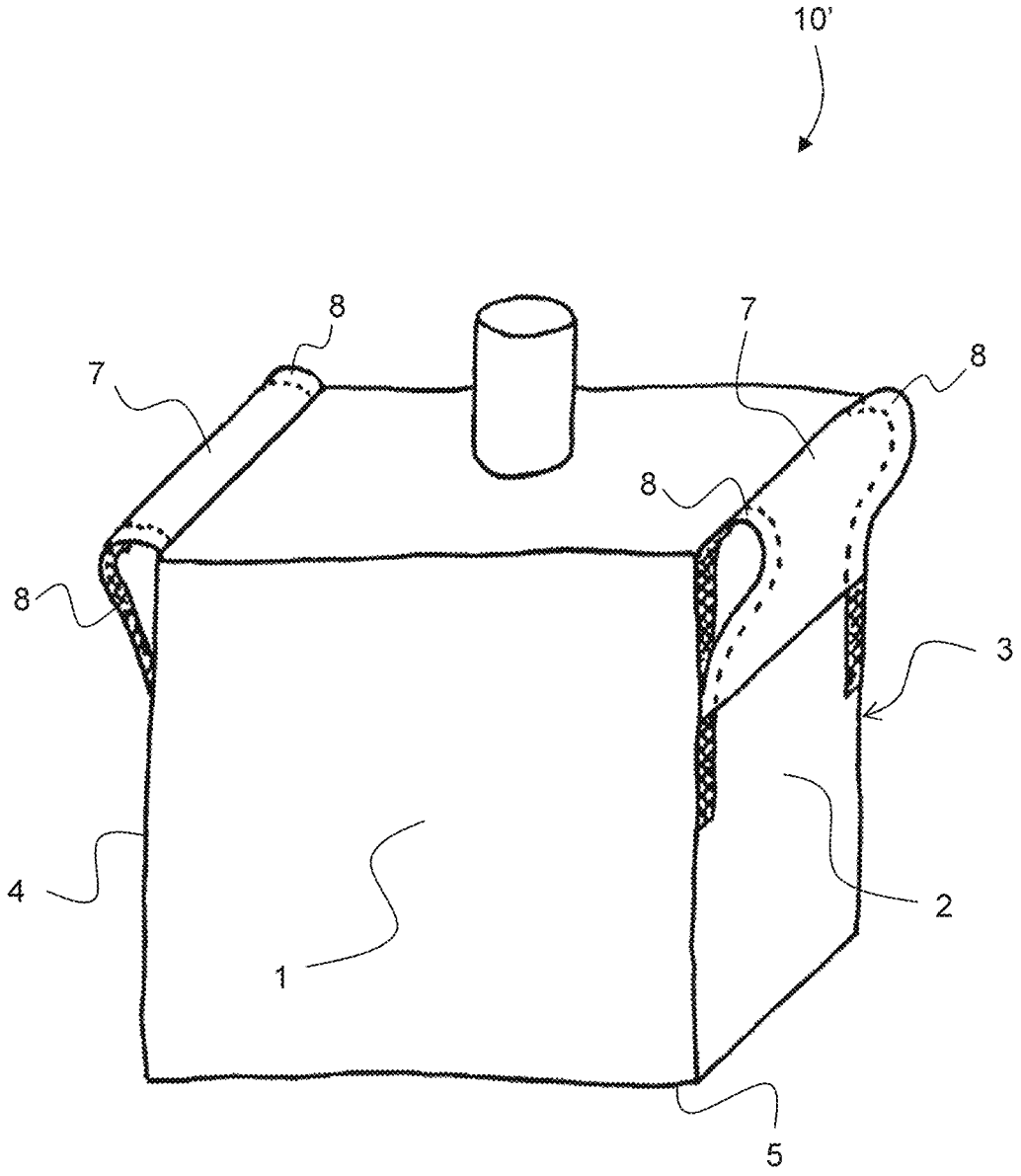
Fig. 1B (PRIOR ART)
Figure 1C:
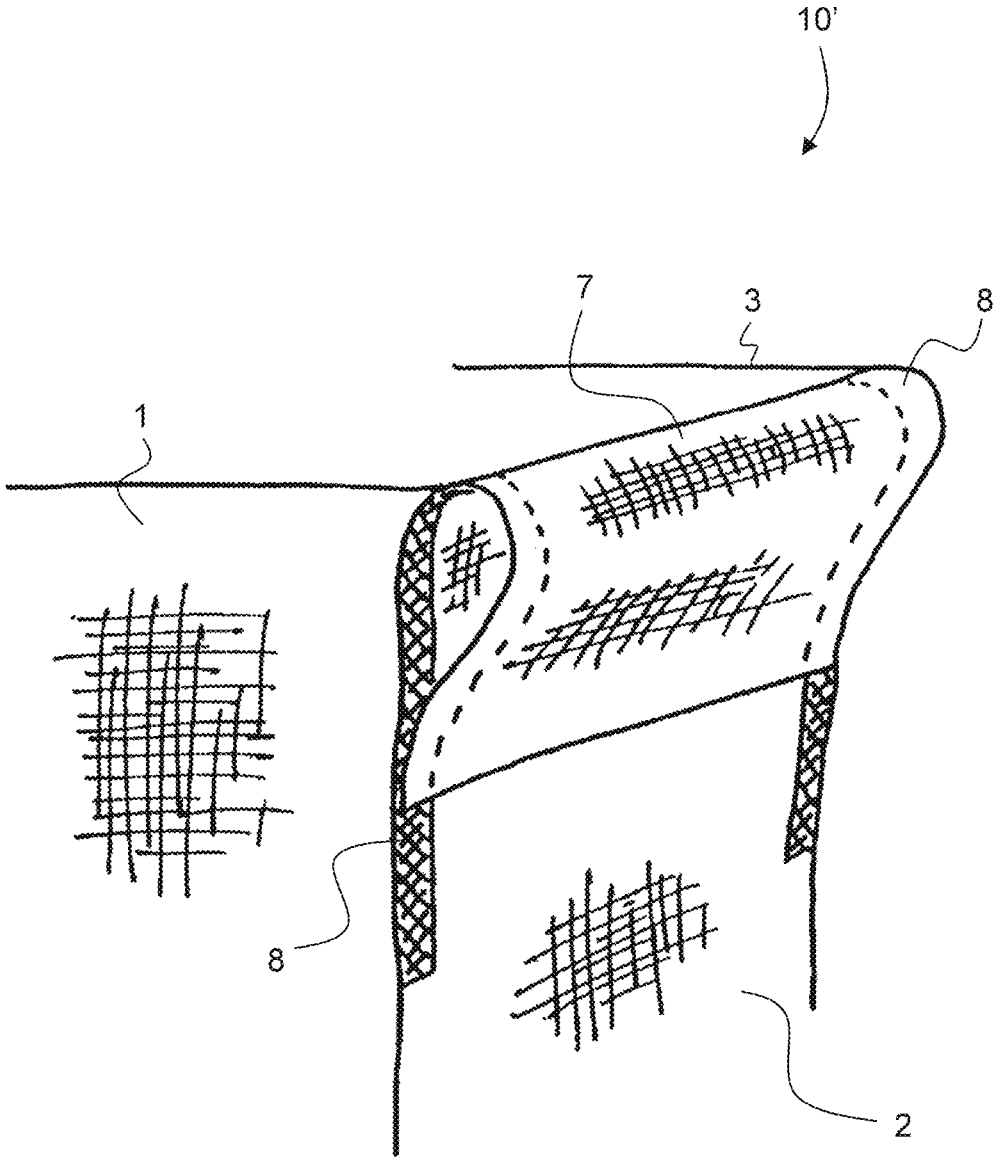
Fig. 1C (PRIOR ART)
Figure 1D:
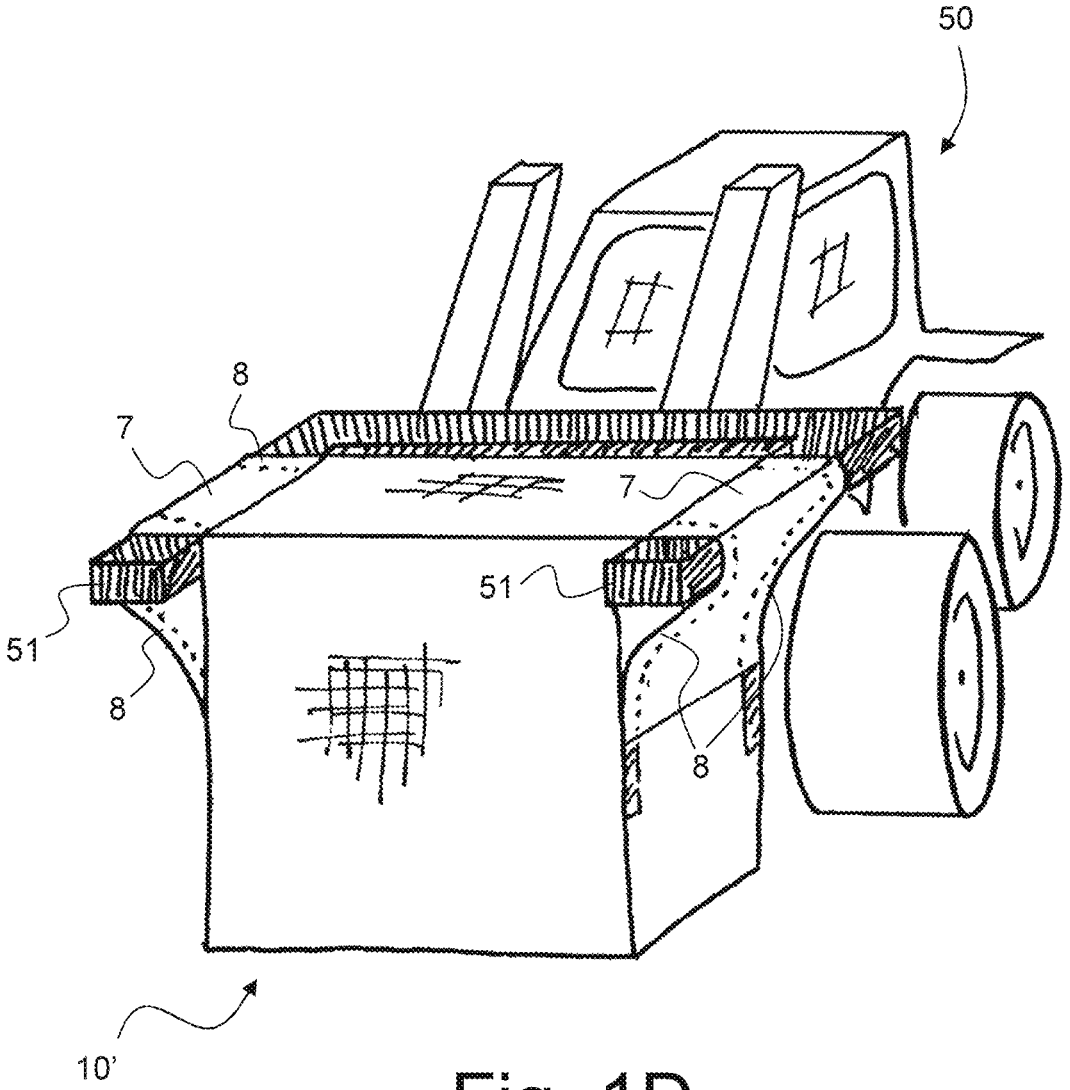
Fig. 1D (PRIOR ART)

The present invention will be described in relation to various illustrative embodiments as shown in particular in the photographic illustrations of FIGS. 2A-D to 5. It shall be understood that the scope of the invention encompasses all combinations and sub-combinations of the features of the invention disclosed herein.

FIGS. 2A-D are photographic illustrations of a bag in accordance with a preferred embodiment of the invention, which bag is generally identified by reference numeral 100. Two such bags 100 are actually visible in FIGS. 2A and 2B. The bag 100 typically exhibits a generally cubic or cuboid shape, with possibly different width, length and height dimensions, depending on the relevant application and goods to be transported and stored. The bag dimensions (be it the width, length or height) may in particular range from approximately 60 to more than 200 centimetres, which dimensions shall however be understood as being mentioned for the purpose of illustration only.

Bag 100 is preferably manufactured from woven fabric using e.g. synthetic fibre materials (such as polypropylene or polyethylene materials), which fabric is cut into pieces that are sewn and/or welded together to form the bag structure. By way of illustration, reference can be made to International (PCT) Publication No. WO 01/18293 A1 in the name of the present Applicant, which publication is incorporated herein by reference in its entirety.

Bag 100 comprises a main body 11-15 including at least a bottom part 15 and four sides 11 to 14, namely a front side 11, a rear side 13, and two opposite lateral sides 12, 14, connected in pairs along adjacent edges to form vertical ridges at four corners of the bag 100. Bag 100 may optionally be provided with a lid closing the upper part thereof and provided with an aperture or spout to transfer goods inside the storage area of the bag 100, as shown. Bag 100 further comprises four lifting straps 18 that are secured to corresponding ones of the sides 11-14, namely the front and rear sides 11, 13 in the illustrated embodiment. More specifically, each lifting strap 18 includes first and second end sections 18*a*, 18*b* that are secured to the sides 11, 13 of the bag 100, and an intermediate section 18*c* rising above a top surface of the bag 100. The lifting straps 18 are interconnected in pairs by two sleeves 17 to form tubings or ducts extending longitudinally along a top surface of the bag 100, namely along a direction that is substantially parallel to the two opposite lateral sides 12, 14, to allow lifting of the bag 100 by means of a forklift 50, as shown e.g. in FIGS. 3 and 4A-C.

By way of preference, as illustrated, the first and second end section 18*a*, 18*b* of each lifting strap 18 are non-overlapping vertical end sections that are sewn on different portions of the corresponding sides 11, 13 of the bag 100. In the illustrated example, the first end section 18*a* is sewn on the front side 11 or rear side 13, alongside each vertical ridge of the bag 100, whereas the second end section 18*b* is sewn along a portion of the front side 11 or rear side 13 at a distance from each vertical ridge of the bag 100. The intermediate section 18*c* of each lifting strap 18 thus exhibits an inverted-U shape rising above the top surface of the bag 100. The end sections 18*a*, 18*b* advantageously extend and are sewn vertically along substantially all of the relevant portions of the sides 11, 13, namely along at least 80% of the height of each side 11, 13.

In another embodiment, the first end section 18*a* of each lifting strap 18 could alternatively be sewn on the lateral side 12 or 14, alongside each vertical ridge of the bag 100, while the second end section 18*b* remains sewn along a portion of the front side 11 or rear side 13.

According to the invention, and in contrast to the known bags depicted e.g. in FIGS. 1B-G where each sleeve is made of an integral portion of opposite lateral sides of the bag that is bended/looped on itself to form the tubings or ducts, the sleeves 17 are not an integral part of the main body 11-15 of the bag 100. Rather, the sleeves 17 are made of separate pieces of fabric that are shaped into the desired tubings or ducts and are connected to the main body 11-15 of the bag 100 via the lifting straps 18 and are not attached longitudinally to the main body 11-15 of the bag 100. More specifically, a longitudinal spacing is thus created between the sleeves 17 and the main body of the bag 100 (see in particular FIGS. 4A-C), which allows bulging of the main body 11-15 of the bag 100 upon being filled, without however compromising the function of the sleeves 17 and cooperation thereof with the fork arms 51 of the forklift 50. Connection of the sleeves 17 to the main body 11-15 of the bag 100 only at each terminal end thus allows the sleeves 17 to remain parallel to one another and cope with the inherent bulging of the main body 11-15 of the bag 100 as is visible e.g. in FIG. 2D.

In accordance with a particularly preferred embodiment of the invention, the intermediate section 18*c* of each lifting trap 18 is reinforced to force the intermediate section 18*c* into an essentially upright configuration rising above the top surface of the bag 100 when no load is applied onto a top portion of the bag 100. In this way, and as long as no load is applied onto the intermediate section 18*c*, the intermediate section 18*c* is urged by default in an essentially upright configuration above the top surface of the bag 100, as shown e.g. in FIGS. 2A-D. The intermediate sections 18*c* however retain a certain flexibility allowing a flattening of the intermediate sections 18*c* and of the associated sleeves 17, especially upon stacking another bag on top of the bag 100, as shown e.g. in the photographic illustration of FIG. 3.

Reinforcement of each intermediate section 18*c* can in particular be achieved by means of a flexible reinforcement tube that is provided in such a way as to surround the intermediate section 18*c*. Such flexible reinforcement tubes are partly visible in the photographic illustrations of FIGS. 4A-C and 5, and are designated by reference numeral 180, it being to be understood that terminal ends of the sleeves 17 are in effect wrapped around these flexible reinforcement tubes 180 in the illustrated example.

The flexible reinforcement tubes 180 may conveniently be made of a flexible polymer or biopolymer material, such as polyvinyl chloride (PVC), polyethylene (PE), bio-polyethylene (bio-PE), polypropylene (PP), bio-polypropylene (bio-PP) or silicone. Other flexible reinforcement materials may however be contemplated.

By way of preference, each terminal end of the sleeves 17 is provided with a hem 17A (visible especially in FIGS. 2D, 4A-C and 5) surrounding part of the intermediate section 18*c* of the associated lifting strap 18 and thereby providing connection of the sleeves 17 to the main body 11-15 of the bag 100. As already mentioned, a particularity of the sleeves 17 resides in that they are not longitudinally attached to the main body 11-15 of the bag 100. In the illustrated example, each hem 17A in effect surrounds part of the flexible reinforcement tube 180 and a longitudinal spacing is created between the sleeves 17 and the main body 11-15 of the bag 100.

Each hem 17A may conveniently be formed by folding and stitching a terminal portion at each terminal end of the sleeves 17. In practice, a terminal portion of the order of 5 to 10 cm may suffice to form each hem 17A. By way of preference, the hem is not however stitched to the intermediate section 18*c* of the associated lifting strap 18.

In accordance with a particularly advantageous embodiment, each hem 17A is configured to allow a relative movement of the hem 17A with respect to the intermediate section 18*c* (and flexible reinforcing tube 180) of the associated lifting strap 18. This in effect allows some movement between the sleeves 17 and the lifting straps 18 upon lifting the bag 100, as shown e.g. in FIG. 4C, thereby reducing stresses and tensions.

In effect, according to the present invention, the sleeves 17 are subjected to far lesser stresses upon lifting of the bag 100, the greatest part of the load being supported by the lifting straps 18 and the main body 11-15 of the bag 100. Thanks to the fact that the sleeves 17 are not directly attached to the main body 11-15 of the bag 100, the sleeves 17 are furthermore not anymore subjected to important tensions and deformations as is the case with the known bags. As a result, the bag 100 retains a better and more uniform overall shape upon being lifted.

Figure 4A:
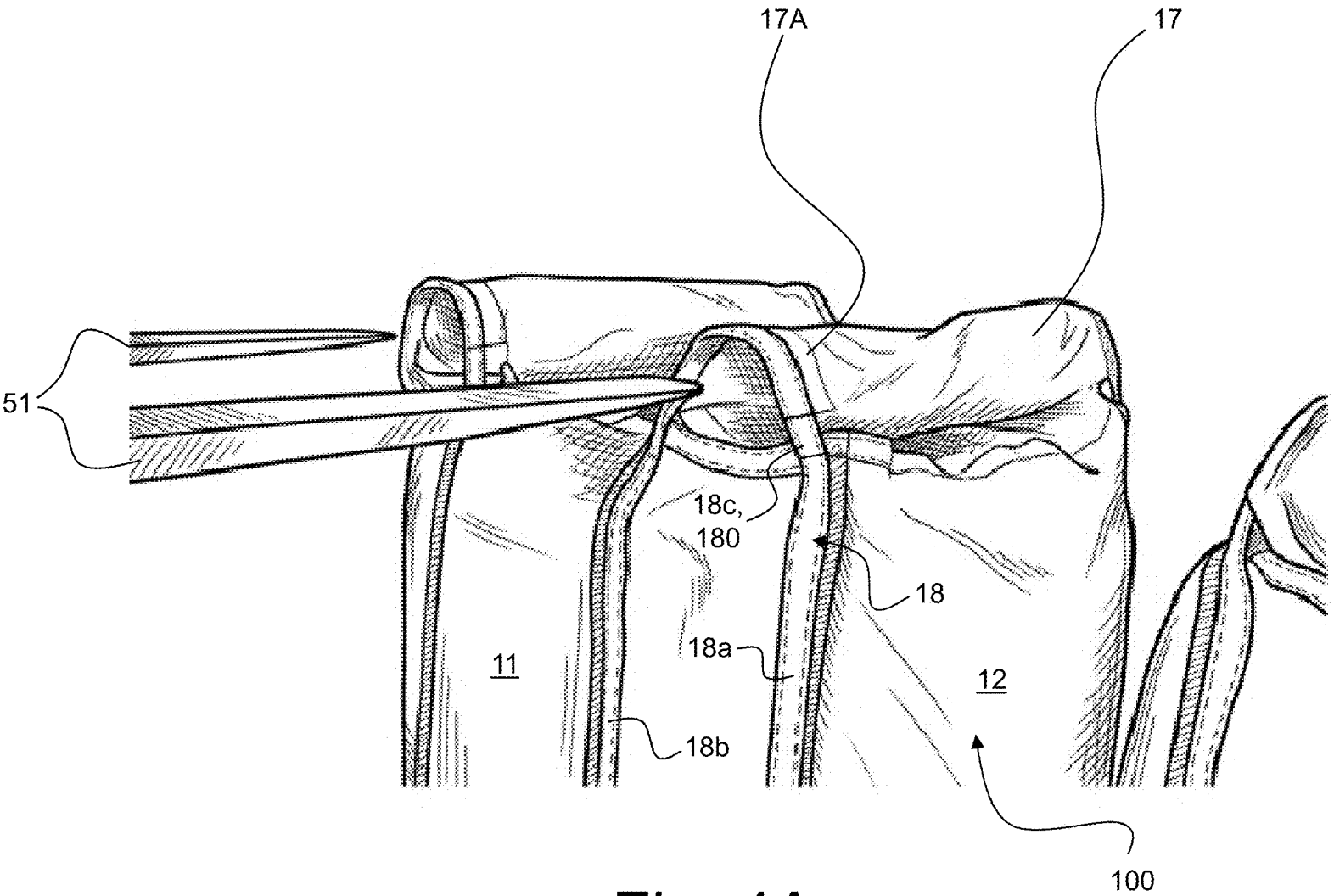
FIGS. 4A-C are photographic illustrations showing a pair of fork arms of a forklift being inserted through the pair of sleeves provided in a top portion of the bag as shown in FIGS. 2A-D.
Figure 4B:
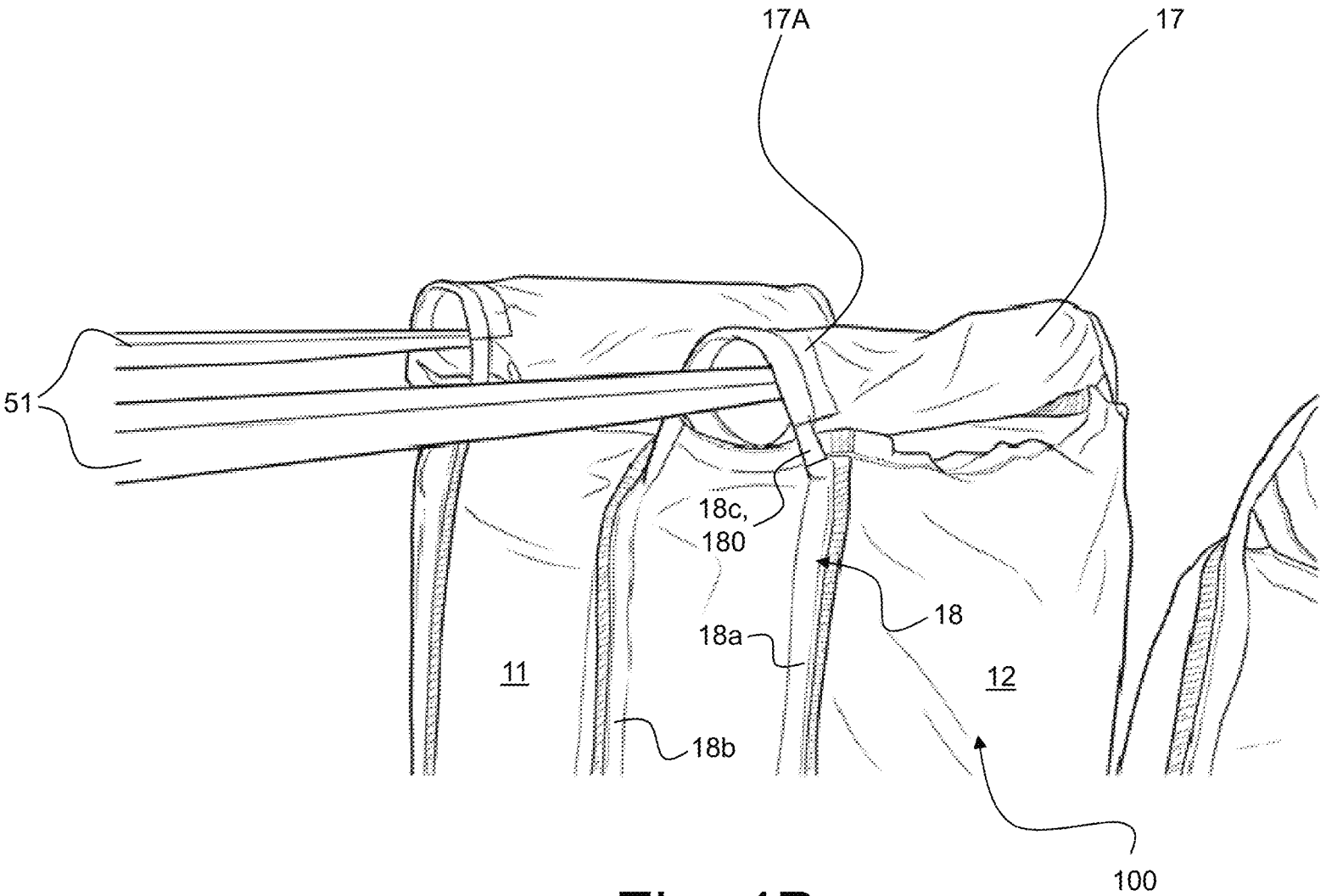
Figure 4C:
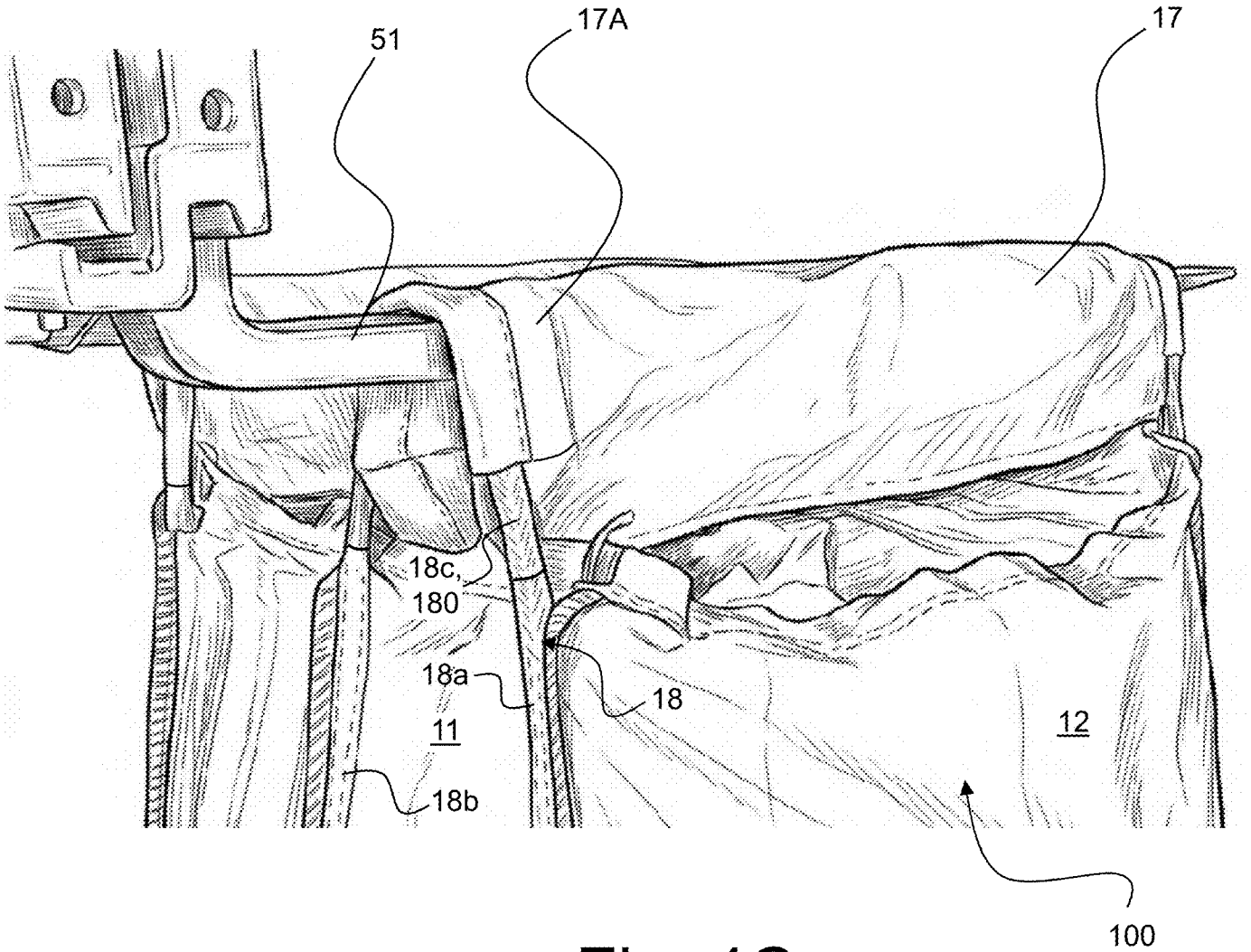
Figure 5:
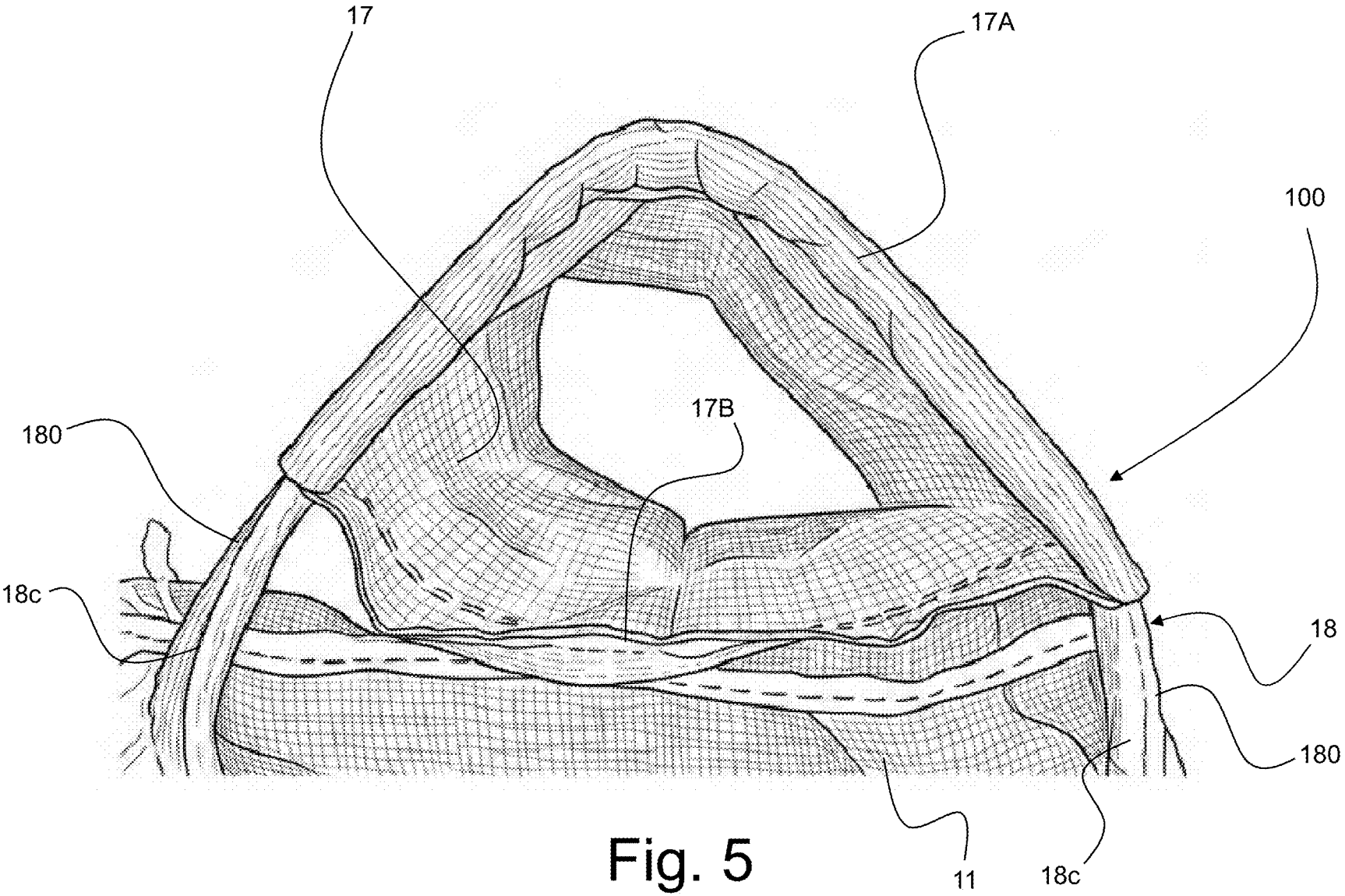
FIG. 5 is a photographic illustration showing a close-up of a terminal end of one of the sleeves.

By way of preference, as shown e.g. in FIG. 5, a bottom portion 17B of each sleeve 17, at each terminal end of each sleeve 17, is secured to the top surface of the bag 100, for instance by stitching or by any other adequate means. The bottom portion 17B could in effect be secured permanently or non-permanently to the top surface of the bag 100, for instance by means of Velcro elements. This ensures that each terminal end of each sleeve 17 remains in a generally open configuration to facilitate insertion of the fork arms 51 of a forklift 50 as shown in FIGS. 4A-C.

The sleeves 17 shown in FIGS. 2A-D to 5 are made of the same fabric material as the main body 11-15 of the bag 100, but the sleeves 17 could in effect be made of any suitable material. In particular, the sleeves 17 may advantageously be made of a transparent or translucent material to facilitate handling operations with a forklift, thereby providing the ability for the operator to have visual feedback during insertion and extraction of the fork arms 51 in and out of the sleeves 17.

The bag of the invention also leads to substantial simplification of the steps required to produce the bag. Indeed, referring to the bag 100 illustrated by FIGS. 2A-C to 5, each required pair of sleeves 17 may be produced independently of the main body 11-15 of the bag 100, and each terminal end of each sleeve 17 can simply be connected to an intermediate section 18*c* of a corresponding lifting strap 18 (preferably by means of a hem 17A as previously discussed), even before the lifting straps 18 are actually secured to the main body 11-15 of the bag. In particular, a sub-assembly consisting of one sleeve 17 connected to a pair of lifting straps 18 (including by way of preference optional reinforcement of the intermediate section 18*c*) may be produced independently of the main body 11-15 of the bag 100. Stitching of the end sections 18*a*, 18*b* of each lifting strap 18 to corresponding ones of the sides 11-14 of the bag 100 may accordingly be performed as a separate, possibly final production step.

The end sections 18*a*, 18*b* of each lifting strap 18 could be stitched to the desired portions of the sides 11-14 of the bag 100 by any suitable stitching techniques, including e.g. specific stitching techniques aimed at ensuring improved load resistance.

Various modifications and/or improvements may be made to the above-described embodiments without departing from the scope of the invention as defined by the appended claims. For instance, while the bag is shown as being of generally cubic form, the bag could exhibit a more elongated shape in one direction, for instance be taller or wider, depending on the relevant application.

LIST OF REFERENCE NUMERALS AND SIGNS USED THEREIN

10 bag (prior art of FIG. 1A)
10' bag (prior art of FIGS. 1B to 1D)
10" bag (prior art of FIG. 1E)(
10'" bag (prior art of FIGS. 1F and 1G)
1 first side of bag 10, 10', 10", 10'"
2 second side of bag 10, 10', 10", 10'"
3 third side of bag 10, 10', 10", 10'"
4 fourth side of bag 10, 10', 10", 10'"
5 bottom part of bag 10, 10', 10", 10'"

6 lifting straps to allow lifting of the bag 10 by means of a four-point lifting device (prior art of FIG. 1A)

7 first and second sleeves interconnecting lifting straps 8 in pairs and forming tubings or ducts to allow lifting of the bag 10', 10" or 10'" by means of a forklift (prior art of FIGS. 1B-G)

8 lifting straps provided at four corners of bag 10', 10", 10'" and forming an integral part of sleeves 7 (prior art of FIGS. 1B-G)

Figure 1E:
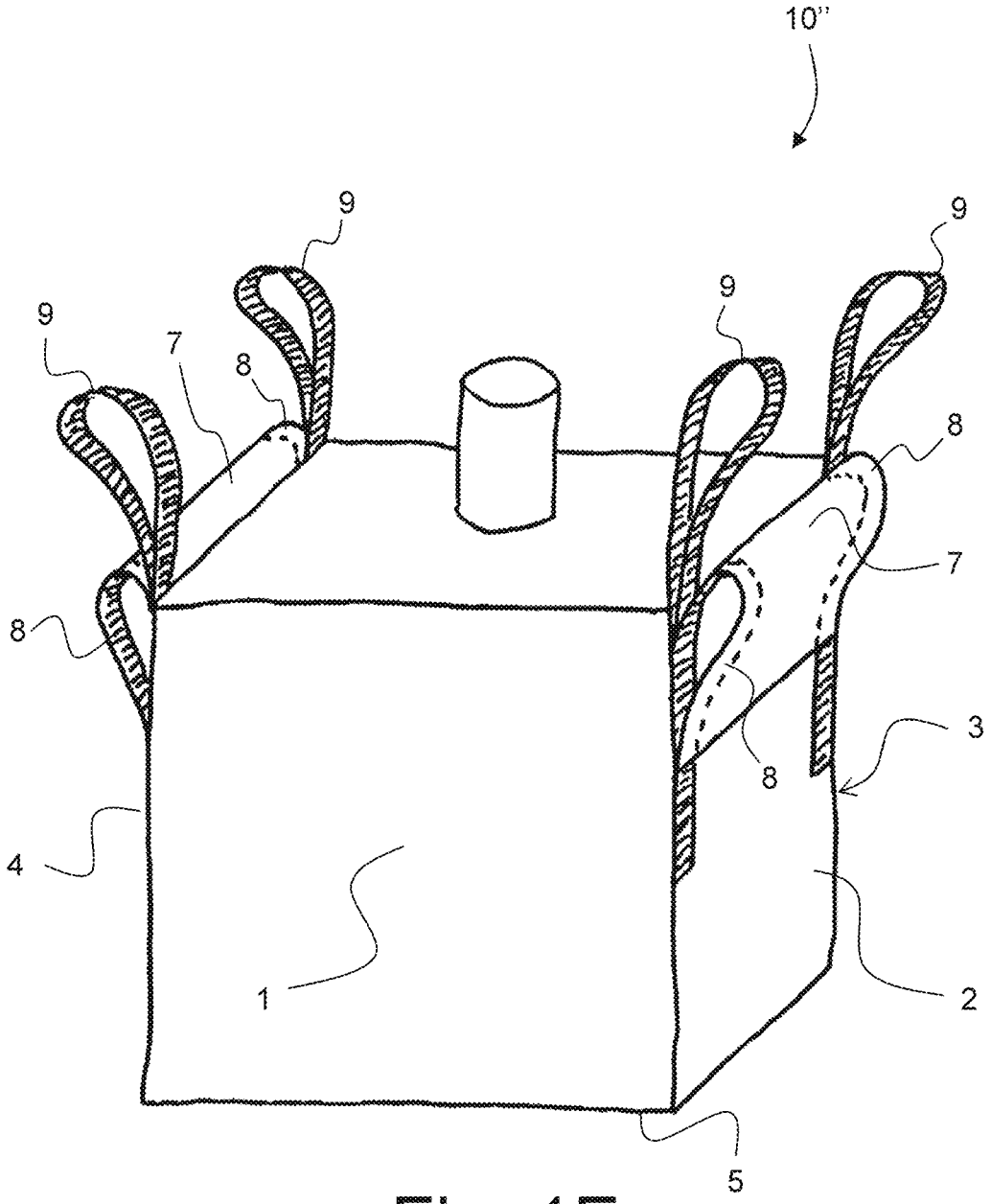
Fig. 1E (PRIOR ART)
Figure 1F:
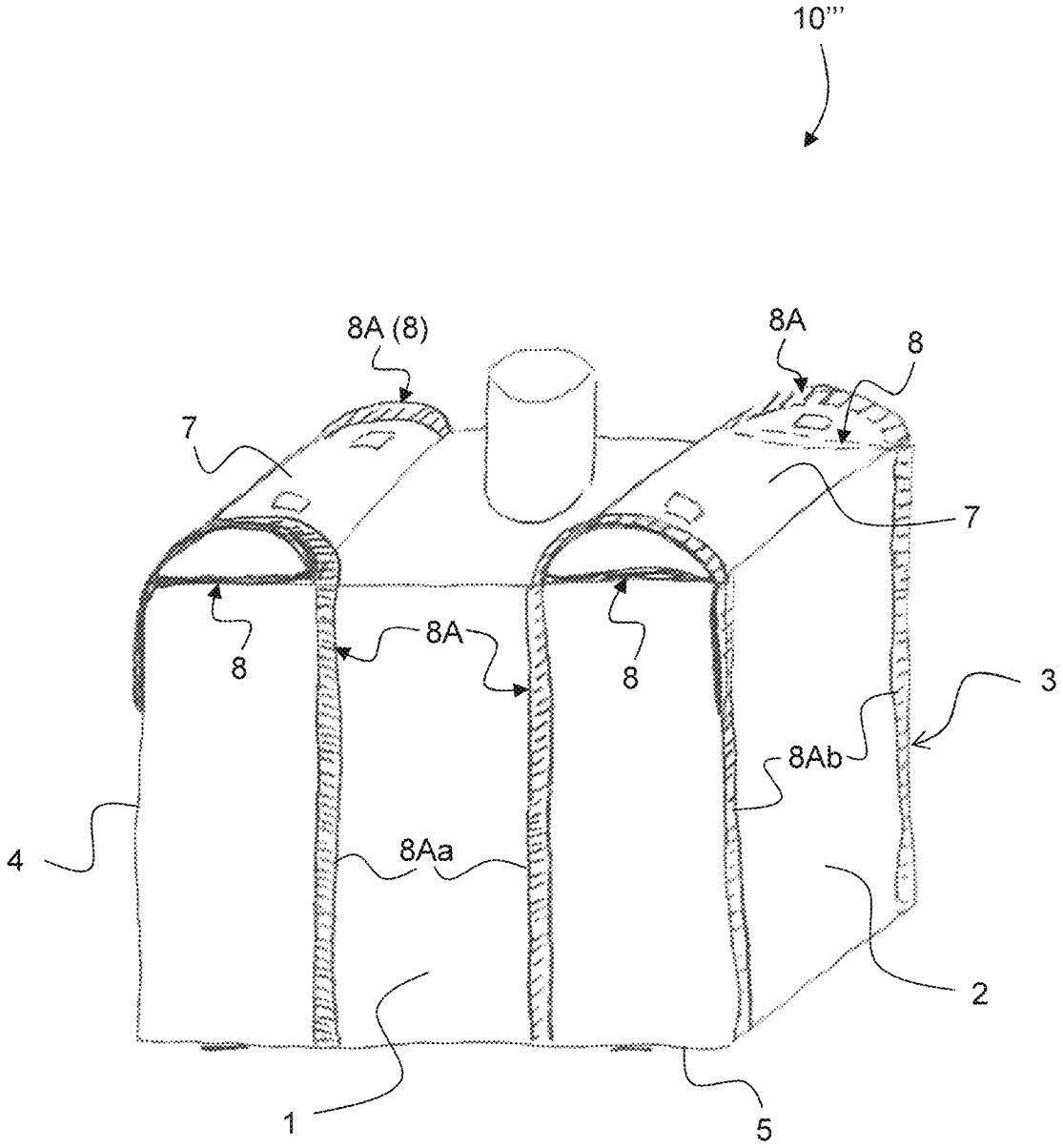
Fig. 1F (PRIOR ART)
FIGS. 1F and 1G are schematic illustrations of another prior art bag as disclosed e.g. in International (PCT) Publication No. WO 2018/142196 A1.
Figure 1G:
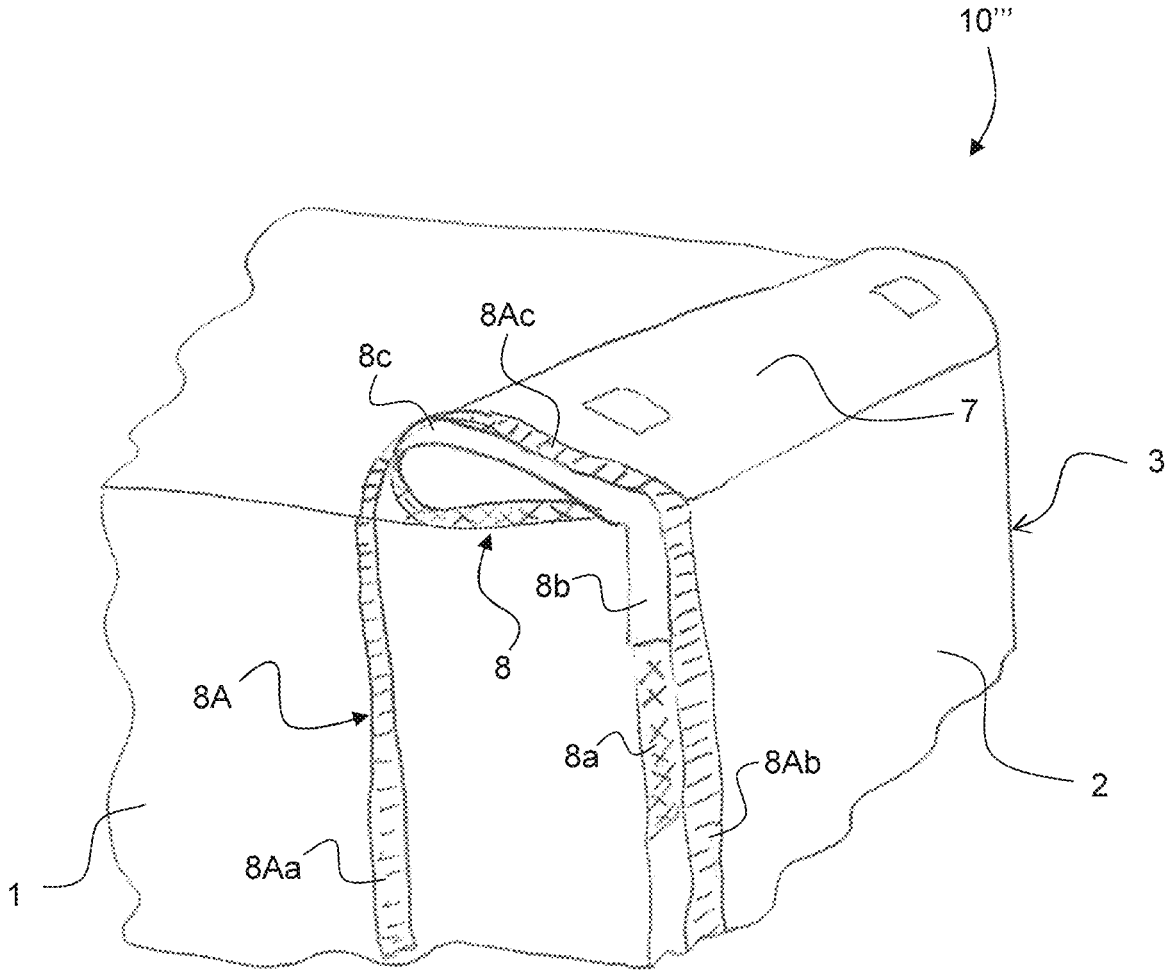
Fig. 1G (PRIOR ART)
Figure 2A:
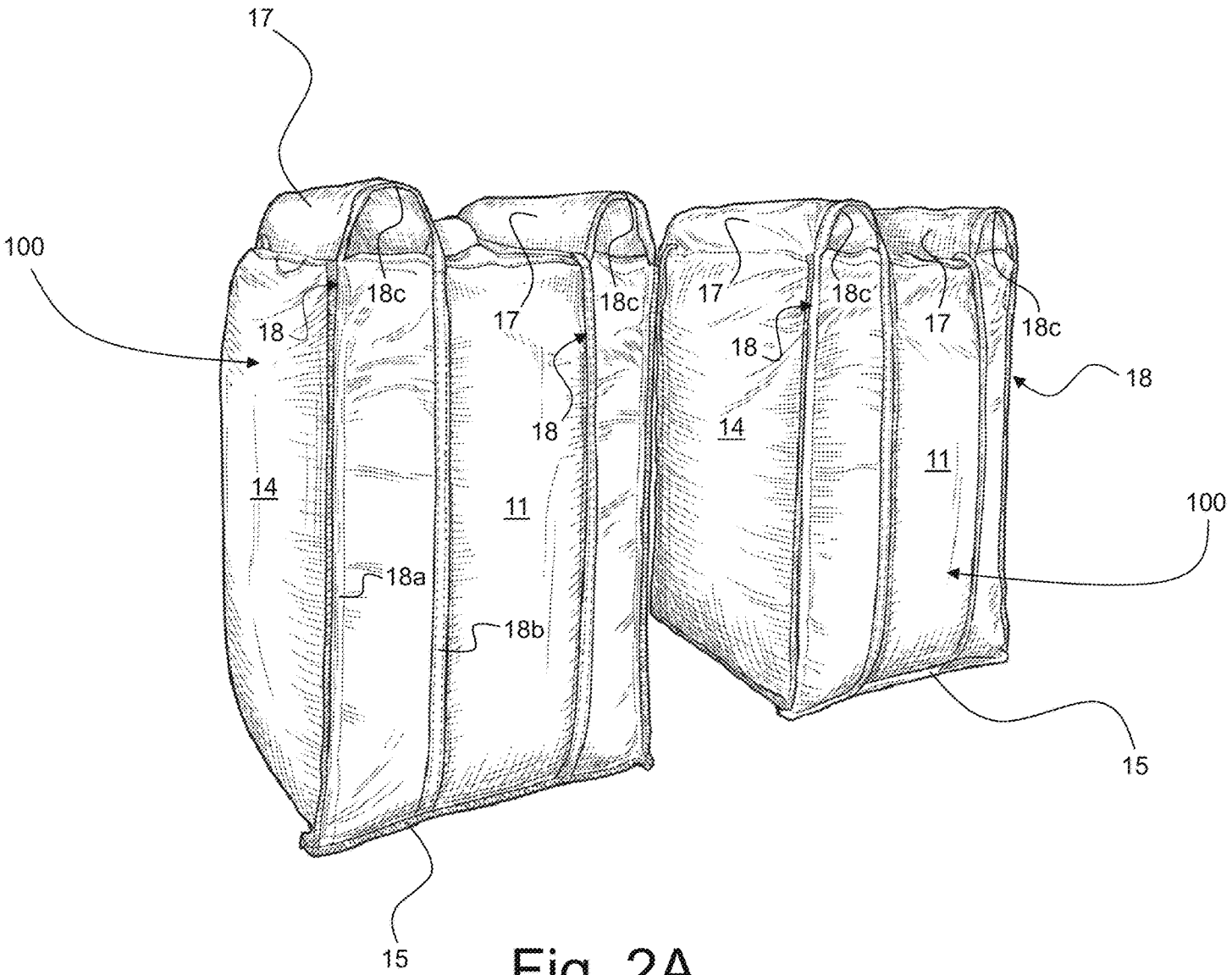
FIGS. 2A-D are photographic illustrations of bags in accordance with an embodiment of the invention.
Figure 2B:
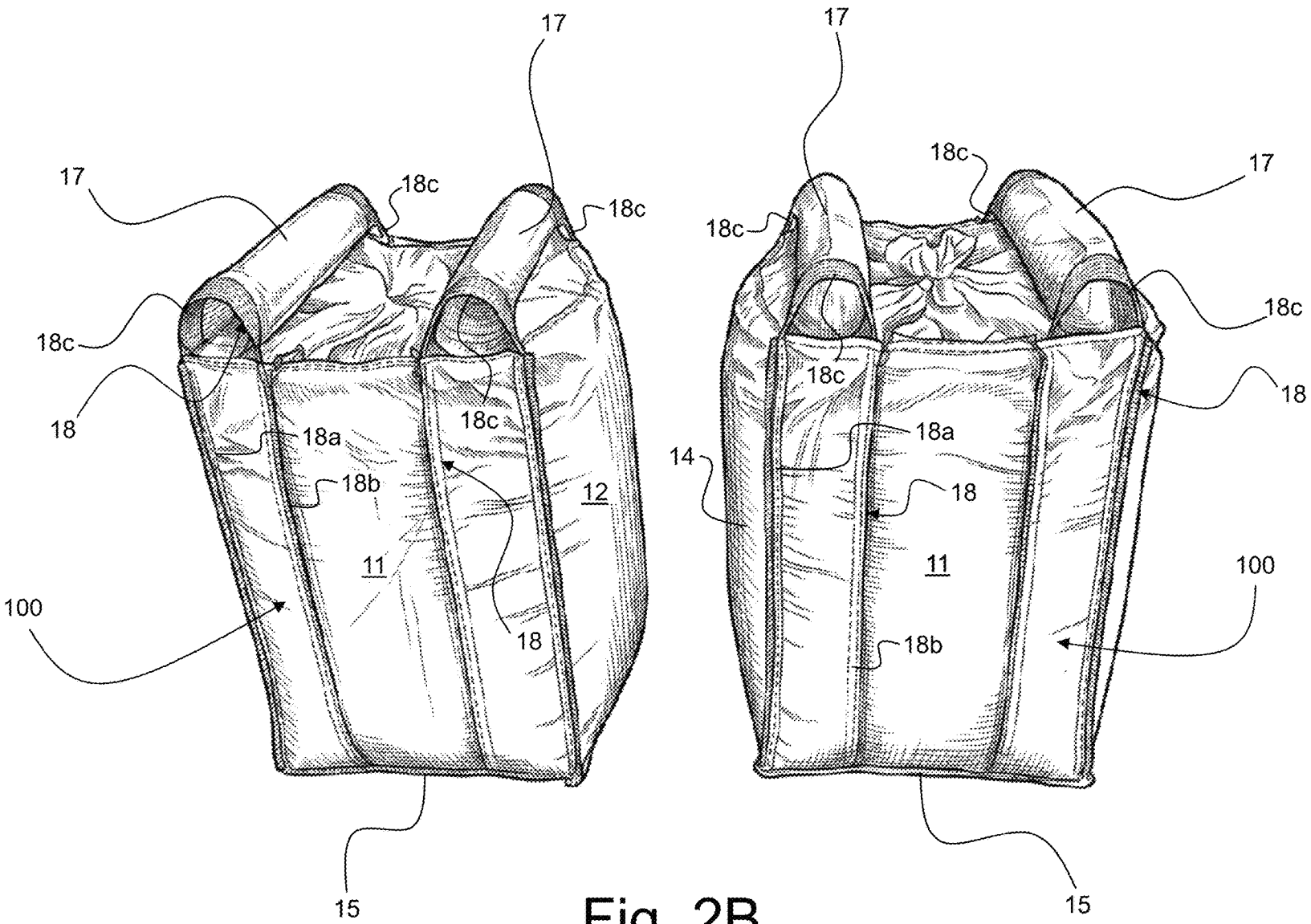
Figure 2C:
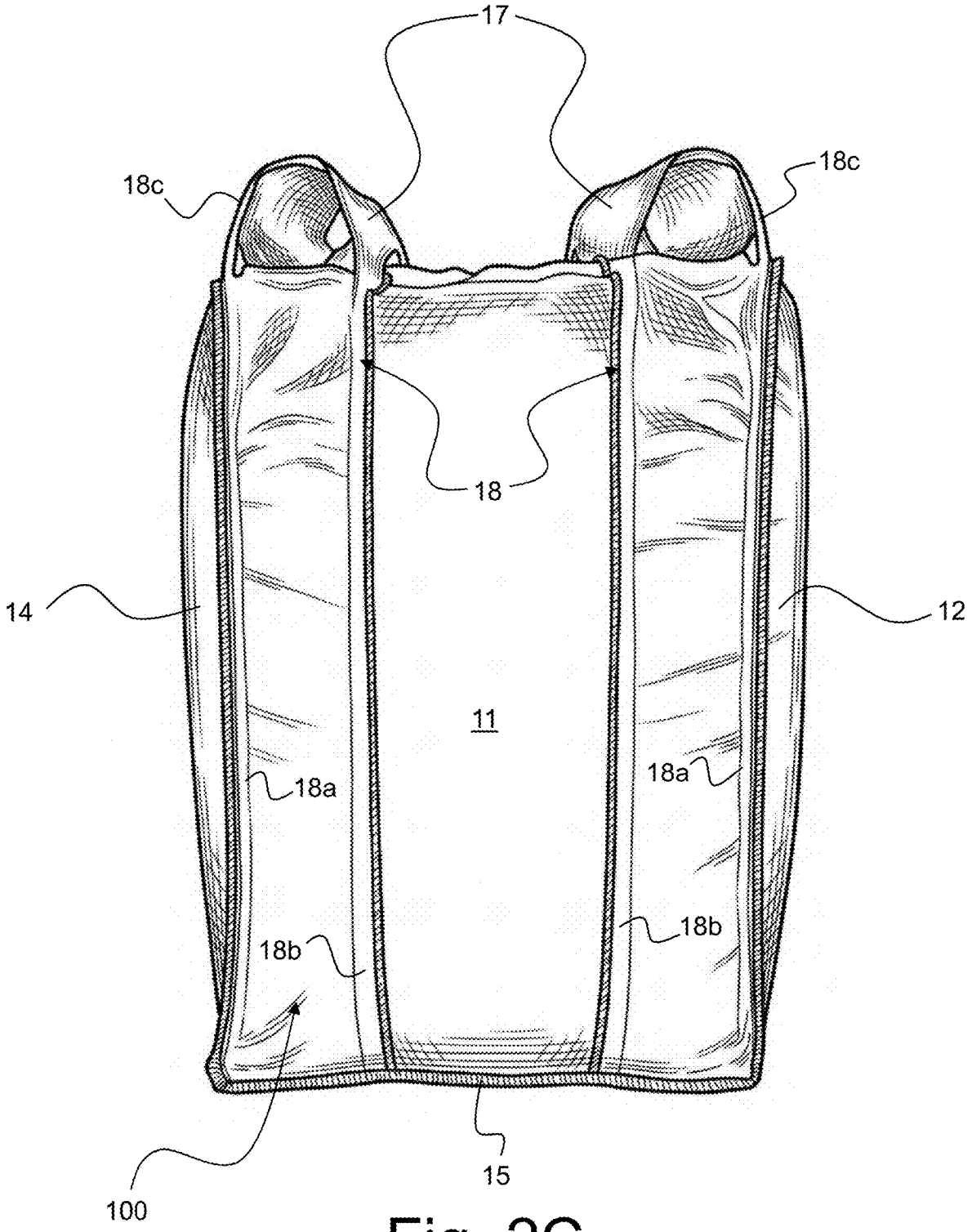
Figure 2D:
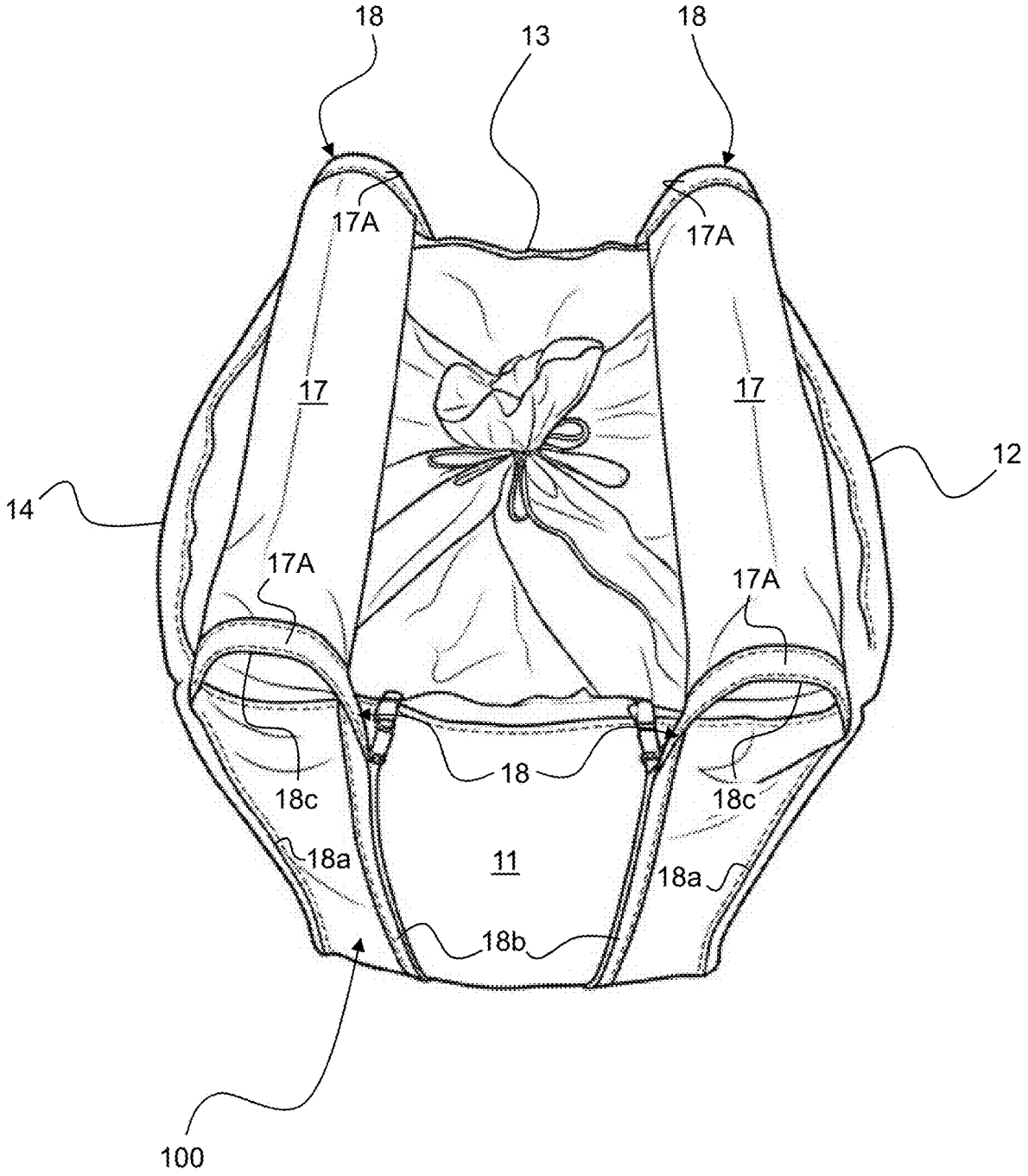
Figure 3:
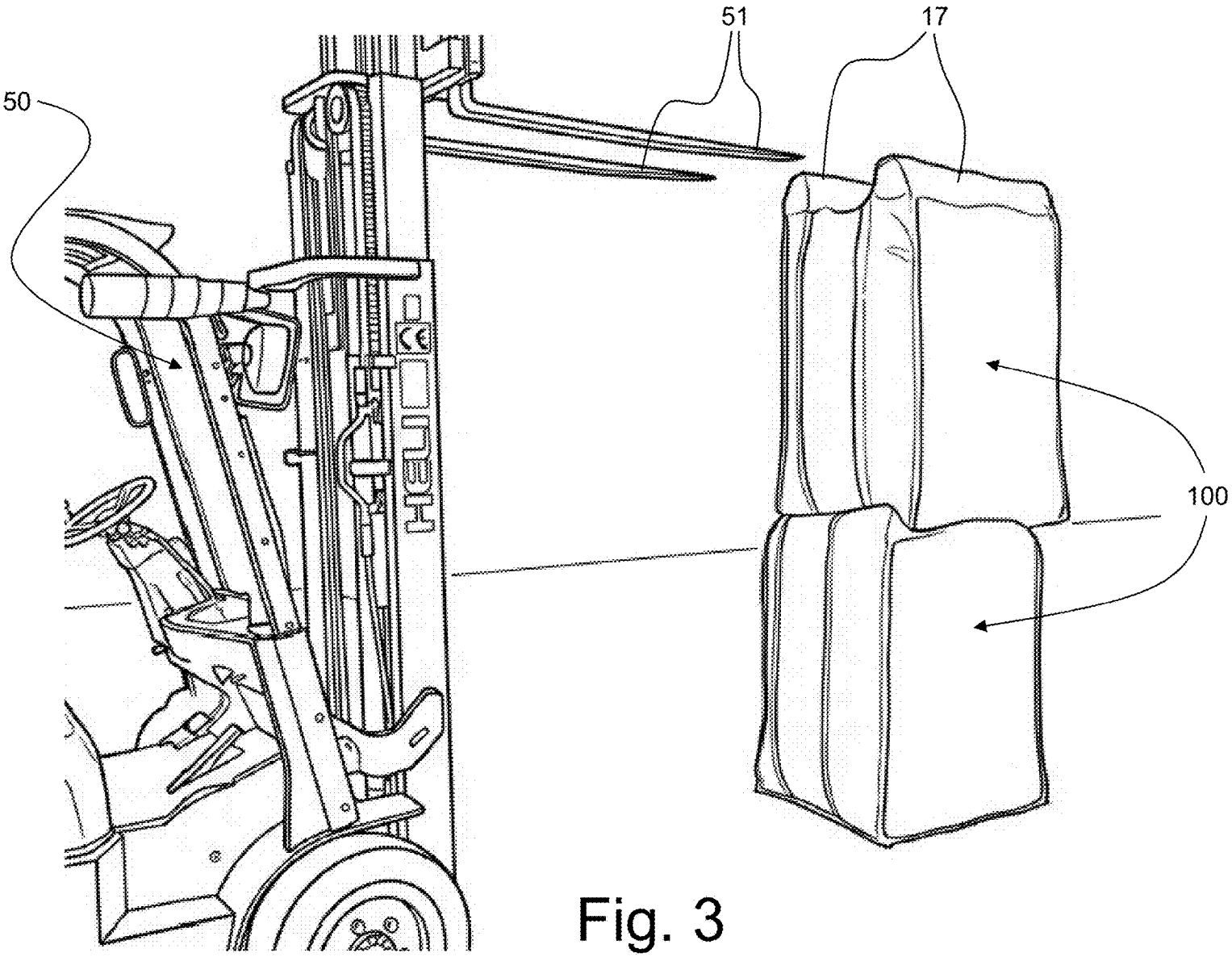
FIG. 3 is a photographic illustration of two bags as shown in FIGS. 2A-D being disposed one on top of the other.

8*a*, 8*b* first and second ends of lifting strap 8 secured to e.g. by sewing along the vertical ridge of the bag 10'" (prior art of FIGS. 1F and 1G)

8*c* intermediate section of lifting strap 8 positioned lengthwise along upper edge of bag 10'" (prior art of FIGS. 1F and 1G)

8A restraining straps (prior art of FIGS. 1F and 1G)

8Aa, 8Ab non-overlapping vertical sections of restraining strap 8A (prior art of FIGS. 1F and 1G)

8Ac U-shaped intermediate section of restraining strap 8A positioned over intermediate section 8*c* and at least partially sewn thereon (prior art of FIGS. 1F and 1G)

9 additional lifting straps to allow lifting of the bag 10' (or 10") by means of a four-point lifting device (prior art of FIG. 1E)

50 forklift

51 fork arms of forklift 50

100 bag according to the invention (preferred embodiment)

11 first side (front side) of bag 100

12 second side (lateral side) of bag 100

13 third side (rear side) of bag 100 (opposite to side 11)

14 fourth side (lateral side) of bag 100 (opposite to side 12)

15 bottom part of bag 100

17 first and second sleeves interconnecting lifting straps 18 in pairs and forming tubings or ducts extending longitudinally along the top surface of bag 100 to allow lifting of the bag 100 by means of a forklift

17A hem provided at each terminal end of the first and second sleeves 17

17B bottom portion of each sleeve 17, at each terminal end of the first and second sleeves 17, secured to top surface of bag 100

18 lifting straps provided at four corners of bag 100 and connected to terminal ends of sleeves 17

18*a* (first) end section of lifting strap 18 secured to front side 11 or rear side 13

18*b* (second) end section of lifting strap 18 secured to front side 11 or rear side 13

18*c* U-shaped intermediate section of lifting strap 18 rising above top surface of bag 100

180 flexible reinforcement tube surrounding intermediate section 18*c* of each lifting strap 18

The invention claimed is:

1. A bag for the transport and storage of bulk goods comprising a main body including at least a bottom part and four sides connected in pairs along adjacent edges to form vertical ridges at four corners of the bag, wherein the bag further comprises four lifting straps, each comprising first and second end sections and an intermediate section rising above a top surface of the main body of the bag, wherein the lifting straps are interconnected in pairs by two sleeves to form tubings or ducts extending longitudinally along the top surface of the main body of the bag to allow lifting of the bag by means of a forklift, wherein terminal ends the sleeves are connected to the main body of the bag via the lifting straps, wherein a longitudinal length of each sleeve, between the terminal ends, is not attached to the main body of the bag to form a longitudinal spacing between the sleeves and the main body, wherein the first and second end sections of each lifting strap are secured to corresponding sides of the bag, wherein the intermediate section of each lifting strap is reinforced to force the intermediate section into an essentially upright configuration rising above the top surface of the main body of the bag when no load is applied onto a top portion of the bag, and wherein the intermediate section is reinforced by means of a flexible reinforcement tube surrounding the intermediate section.

2. The bag according to claim 1, wherein the first and second end sections of each lifting strap are non-overlapping vertical end sections that are sewn on different portions of the corresponding sides of the bag, and wherein the intermediate section of each lifting strap is a U-shaped intermediate section rising above the top surface of the main body of the bag.

3. The bag according to claim 2, wherein the first and second end sections extend and are sewn vertically along substantially all of relevant portions of the corresponding sides of the bag.

4. The bag according to claim 2, wherein the first and second end sections are sewn on different portions of a front or rear side of the bag.

5. The bag according to claim 1, wherein the flexible reinforcement tubes are made of a flexible polymer or biopolymer material.

6. The bag according to claim 1, wherein the terminal ends of the sleeves are each provided with a hem surrounding part of the flexible reinforcement tube, and thus part of the intermediate section of the associated lifting strap, and thereby provide connection of the terminal ends of the sleeves to the main body of the bag via the lifting straps.

7. The bag according to claim 6, wherein each hem is formed by folding and stitching a terminal portion at each terminal end of the sleeves.

8. The bag according to claim 7, wherein the hem is not stitched to the intermediate section of the associated lifting strap.

9. The bag according to claim 6, wherein each hem is configured to allow a relative movement of each hem with respect to the intermediate section of the associated lifting strap.

10. The bag according to claim 1, wherein a bottom portion of each sleeve, at each terminal end of each sleeve, is secured to the top surface of the main body of the bag while maintaining the longitudinal spacing between the sleeves and the main body.

11. The bag according to claim 1, wherein the sleeves are made of a transparent or translucent material.

12. The bag according to claim 5, wherein the flexible reinforcement tubes are made of polyvinyl chloride (PVC), polyethylene (PE), bio-polyethylene (bio-PE), polypropylene (PP), bio-polypropylene (bio-PP) or silicone.

13. A method of producing the bag of claim 1, comprising the following steps:

a) producing a pair of said sleeves independently of the main body of the bag, each sleeve having terminal ends;

b) producing two pairs of said lifting straps;

c) connecting each terminal end of each sleeve to the intermediate section of a corresponding one of the lifting straps; and d) securing the first and second end sections of each lifting strap to the corresponding sides of the bag so that the intermediate section rises above the top surface of the main body of the bag.

14. The method according to claim 13, wherein the first and second end sections of each lifting strap are secured to the corresponding sides of the bag at step d) by stitching.

15. The method according to claim 14, wherein the first and second end sections of each lifting strap are non-overlapping vertical end sections that are sewn at step d) on different portions of the corresponding sides of the bag, and wherein the intermediate section of each lifting strap is a U-shaped intermediate section rising above the top surface of the main body of the bag.

16. The method according to claim 15, wherein the first and second end sections extend and are sewn vertically along substantially all of relevant portions of the corresponding sides of the bag.

17. The method according to claim 15, wherein the first and second end sections are sewn on different portions of a front or rear side of the bag.

18. The method according to claim 13, further comprising the step of reinforcing the intermediate section of each lifting strap to force the intermediate section into an essentially upright configuration rising above the top surface of the main body of the bag when no load is applied onto a top portion of the bag.

19. The method according to claim 18, wherein the intermediate section is reinforced by surrounding the intermediate section of each lifting strap with a flexible reinforcement tube.

20. The method according to claim 19, wherein the flexible reinforcement tubes are made of a flexible polymer or biopolymer material.

21. The method according to claim 13, wherein the step c) of connecting each terminal end of each sleeve to the intermediate section of the corresponding lifting strap includes providing each terminal end of the sleeves with a hem and surrounding part of the intermediate section of the associated lifting strap with the hem, thereby providing connection of the terminal ends of the sleeves to the main body of the bag via the lifting straps.

22. The method according to claim 21, wherein each hem is formed by folding and stitching a terminal portion at each terminal end of the sleeves.

23. The method according to claim 22, wherein the hem is not stitched to the intermediate section of the associated lifting strap.

24. The method according to claim 21, wherein each hem is formed such as to allow a relative movement of each hem with respect to the intermediate section of the associated lifting strap.

25. The method according to claim 19, wherein the step c) of connecting each terminal end of each sleeve to the intermediate section of the corresponding lifting strap includes providing each terminal end of the sleeves with a hem and surrounding part of the flexible reinforcement tube, and thus part of the intermediate section of the associated lifting strap, with the hem, thereby providing connection of the terminal ends of the sleeves to the main body of the bag via the lifting straps.

26. The method according to claim 25, wherein each hem is formed by folding and stitching a terminal portion at each terminal end of the sleeves.

27. The method according to claim 26, wherein the hem is not stitched to the intermediate section of the associated lifting strap.

28. The method according to claim 25, wherein each hem is formed such as to allow a relative movement of each hem with respect to the intermediate section of the associated lifting strap.

29. The method according to claim 13, further comprising the step of securing a bottom portion of each sleeve, at each terminal end of each sleeve, to the top surface of the main body of the bag.

30. The method according to claim 13, wherein the sleeves are made of a transparent or translucent material.

31. The method according to claim 20, wherein the flexible reinforcement tubes are made of polyvinyl chloride (PVC), polyethylene (PE), bio-polyethylene (bio-PE), polypropylene (PP), bio-polypropylene (bio-PP) or silicone.

32. A bag for the transport and storage of bulk goods comprising a main body including at least a bottom part and four sides connected in pairs along adjacent edges to form vertical ridges at four corners of the bag, wherein the bag further comprises four lifting straps, each comprising first and second end sections and an intermediate section rising above a top surface of the main body of the bag, wherein the lifting straps are interconnected in pairs by two sleeves to form tubings or ducts extending longitudinally along the top surface of the main body of the bag to allow lifting of the bag by means of a forklift, wherein terminal ends the sleeves are connected to the main body of the bag via the lifting straps, wherein a longitudinal length of each sleeve, between the terminal ends, is not attached to the main body of the bag to form a longitudinal spacing between the sleeves and the main body, wherein the first and second end sections of each lifting strap are secured to corresponding sides of the bag, and wherein the terminal ends of the sleeves are each provided with a hem surrounding part of the intermediate section of the associated lifting strap and thereby provide connection of the terminal ends of the sleeves to the main body of the bag via the lifting straps.

33. The bag according to claim 32, wherein each hem is formed by folding and stitching a terminal portion at each terminal end of the sleeves.

34. The bag according to claim 33, wherein the hem is not stitched to the intermediate section of the associated lifting strap.

35. The bag according to claim 32, wherein each hem is configured to allow a relative movement of each hem with respect to the intermediate section of the associated lifting strap.

* * * * *